US006718657B2

(12) United States Patent
Chen

(10) Patent No.: US 6,718,657 B2
(45) Date of Patent: Apr. 13, 2004

(54) SHOE WITH ERGONOMIC FOOT PAD

(76) Inventor: Eddie Chen, 9F, No. 201, Sec. 1, Taichung-Kang Rd., Taichung City (TW)

( * ) Notice: Subject to any disclaimer, the term of this patent is extended or adjusted under 35 U.S.C. 154(b) by 56 days.

(21) Appl. No.: 10/141,077

(22) Filed: May 9, 2002

(65) Prior Publication Data

US 2003/0208931 A1 Nov. 13, 2003

(51) Int. Cl.[7] ..... A43B 7/16; A43B 7/14
(52) U.S. Cl. ..... 36/92; 36/88; 36/37; 36/30 R
(58) Field of Search ..... 36/88, 92, 37, 36/35 R, 30 R, 93, 12

(56) References Cited

U.S. PATENT DOCUMENTS 1,372,709 A * 3/1921 McBrearty ..... 36/173
2,135,135 A * 11/1938 Gilkerson et al. ..... 36/37
2,403,442 A * 7/1946 Klaus ..... 36/87
4,124,946 A * 11/1978 Tomlin ..... 36/43
4,622,764 A 11/1986 Boulier
4,858,340 A * 8/1989 Pasternak ..... 36/88
4,878,301 A * 11/1989 Kiyosawa ..... 36/69
6,018,891 A * 2/2000 Duclos ..... 36/69
6,154,983 A * 12/2000 Austin et al. ..... 36/12
6,205,683 B1 * 3/2001 Clark et al. ..... 36/30 R

FOREIGN PATENT DOCUMENTS

DE 4213962 * 11/1993

* cited by examiner

*Primary Examiner*—M. D. Patterson
(74) *Attorney, Agent, or Firm*—Baker Botts L.L.P.

(57) ABSTRACT

A shoe has an ergonomic foot pad disposed inside a cavity formed at an upper side of an outsole and connected to a bottom margin of an upper. The foot pad has a heel part which has a concave upper surface conforming to the contour of the bottom of the wearer's heel, and an upward flange extending along the periphery of the heel part. The thickness of the heel part decreases from the upward flange toward a mid part of the heel part.

2 Claims, 12 Drawing Sheets

SHOE WITH ERGONOMIC FOOT PAD

BACKGROUND OF THE INVENTION

1. Field of the Invention

The invention relates to a shoe which has an ergonomic foot pad, more particularly to an ergonomic foot pad having a heel part with a concave surface conforming to the contour of the wearer's heel.

2. Description of the Related Art

Shoes manufactured by using lasts having planar bottoms generally do not conform to the contours of wearers' feet and thus are insufficient to contact and support all parts of the bottom surface of the wearer's foot. Usually, stress concentration due to the weight of the wearer's body occurs at the foot palm and heel of the wearer which press the shoe sole. Especially, injury can be caused to the mid part of the wearer's heel in case of prolonged wearing of the shoe.

It is known to use a last with a bottom convex face conforming to the bottom of the wearer's foot in manufacturing a sandal. Such a last is shown at (2) in FIGS. 1 and 2 and has a convex bottom face 2A at the bottom of the heel thereof. A sandal 4 made thereby is shown in FIG. 3 and has a foot bed 41 which is received fittingly in a concave top face (not shown) of an outsole 42. The concave top face of the outsole 42 conforms to the contour of the convex bottom face 2A of the last 2 since the outsole 42 is molded by using a mold incorporating the last 2. Since the flexible foot bed 41 follows the contour of the concave top face of the outsole 42, it can contact and support all parts of the convex bottom surface of the wearer's heel so that the stress occurring at the bottom of the wearer's heel can be distributed evenly on the foot bed 41, thus eliminating the problem of stress concentration. However, the production of outsoles having concave surfaces conforming to wearers' feet requires molds which are different from those used to produce outsoles having no such concave surfaces. Since molds used to manufacture outsoles are usually expensive, costs are increased considerably when producing the above two types of outsoles using different molds. In order to save costs, it is desirable that different kinds of shoes can be made by using common outsole molds.

It is usual to provide a shoe with a reinforcement piece, such as a counter or stiffener, at the heel section of the shoe. For example, U.S. Pat. No. 4,622,764 discloses a molded shell made of a rigid material, such as a rigid plastic or metal, so as to reinforce the rear portion of the shoe. The molded shell is placed at the outer side of an upper and is assembled with the upper after the upper is lasted. Since this molded shell has planar top and bottom faces in a heel region, it is insufficient to support all surface areas of the wearer's heel.

SUMMARY OF THE INVENTION

An object of the present invention is to provide a shoe with an ergonomic foot pad which has a concave support face conforming to the contour of the wearer's heel but can be manufactured at a reduced cost as compared to an outsole.

Another object of the invention is to provide a shoe with an ergonomic foot pad which has a heel-conforming concave support face and which can be incorporated into an outsole having no heel-conforming concave surface.

According to the present invention, a shoe comprises: an outsole having a lower tread face, an upper face, and a peripheral flange projecting upward from the upper face and confining a cavity above the upper face, an ergonomic foot pad disposed inside the cavity and cemented to the outsole; an upper connected to the foot pad, the foot pad including a heel part which has a bottom face connected to the outsole, and an upward flange projecting upward from a periphery of the heel part and making a U-shaped turn around the heel part, the heel part further having a concave upper surface which is opposite to the bottom face, the concave upper surface extending gradually upward and outward in a direction from a mid part of the heel part to a top end of the upward flange, the upward flange having an outer surface which forms a corner with the bottom face, the concave upper surface having a curved face opposite to and extending along the corner, the heel part having, between the bottom face and the concave upper surface, a thickness which decreases gradually from the upward flange toward the mid part of the heel part.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
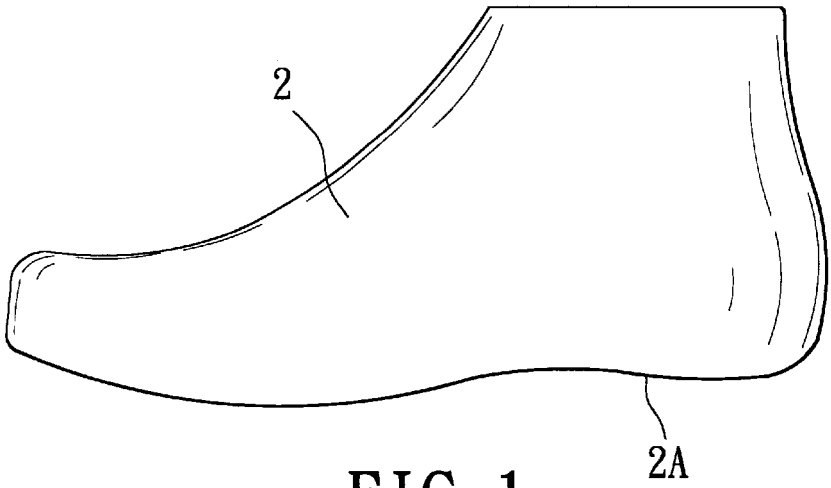
FIG. 1 PRIOR ART
FIG. 1 is a side view of a last which is convex at the bottom of a heel region thereof.
Figure 2:
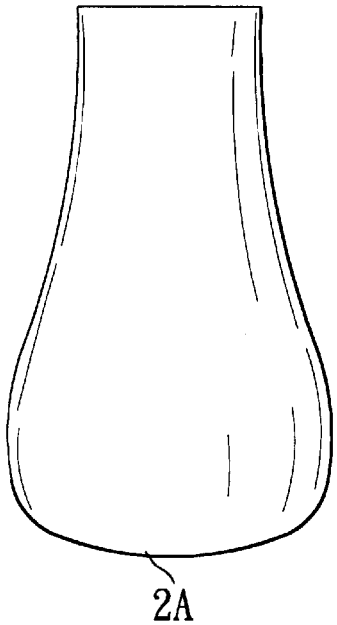
FIG. 2 PRIOR ART
FIG. 2 is a rear view of the last of FIG. 1.
Figure 3:
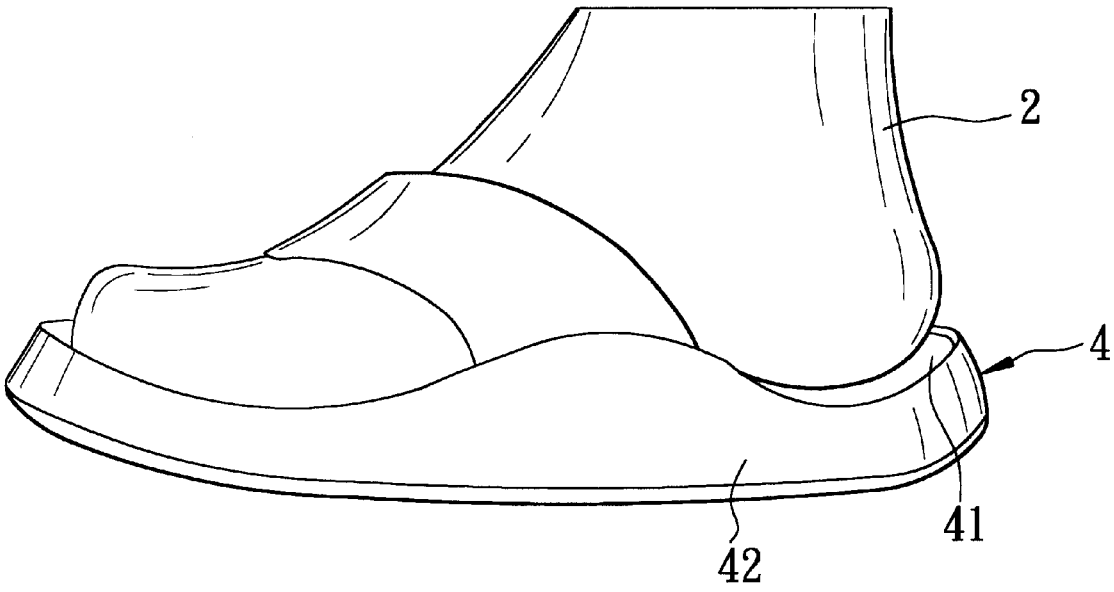
FIG. 3 is a perspective view showing a sandal and the last of FIGS. 1 and 2.
Figure 4:
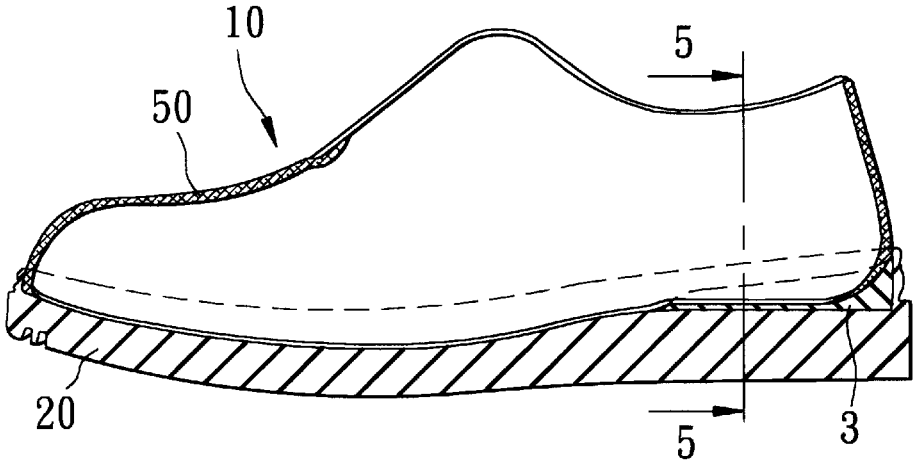
FIG. 4 is a sectional view of a shoe embodying the present invention.

The preferred embodiments of the present invention will be described with reference to FIGS. 4 to 14, in which like elements are represented by like numerals.

Referring to FIGS. 4 to 8, a shoe 10 embodying the present invention is shown to include an outsole 20, an ergonomic foot pad 3, and an upper 50. The outsole 20 has a lower tread face 21, an upper face 22, and a peripheral flange 23 confining a cavity 24. The upper 50 has a bottom margin 51 and an inner sole 53 stitched to the bottom margin 51. A stitch seam 52 is formed at the juncture of the bottom margin 51 and the inner sole 53. The foot pad 3 includes a heel part 30 which is disposed fittingly in the cavity 24 below the inner sole 53 and is cemented to the outsole 20. The upper 50 and the inner sole 53 are slip-lasted and connected to the heel part 30 and the outsole 20.

Figure 6:
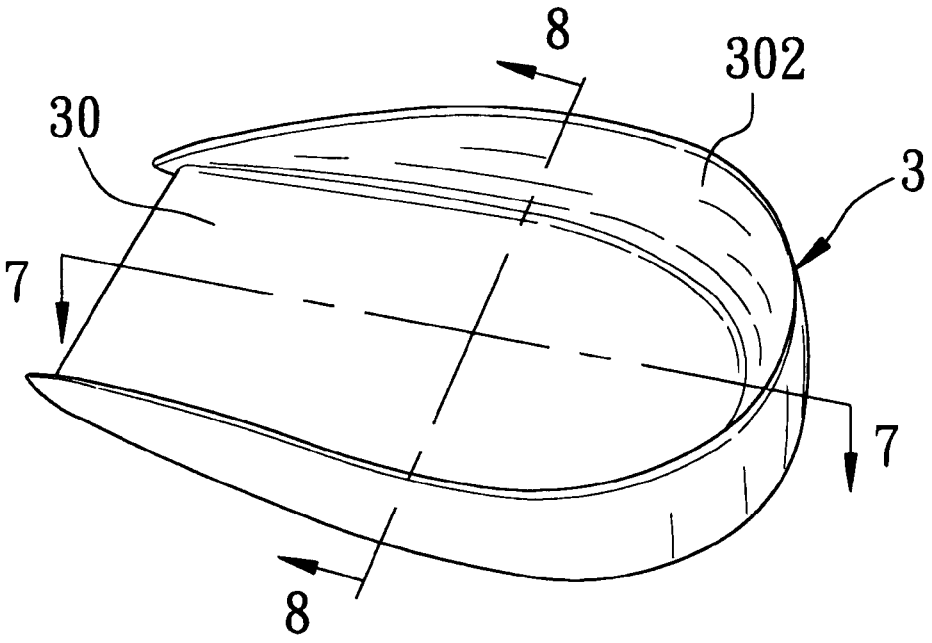
FIG. 6 is a perspective view of a heel part shown in FIG. 4.
Figure 7:
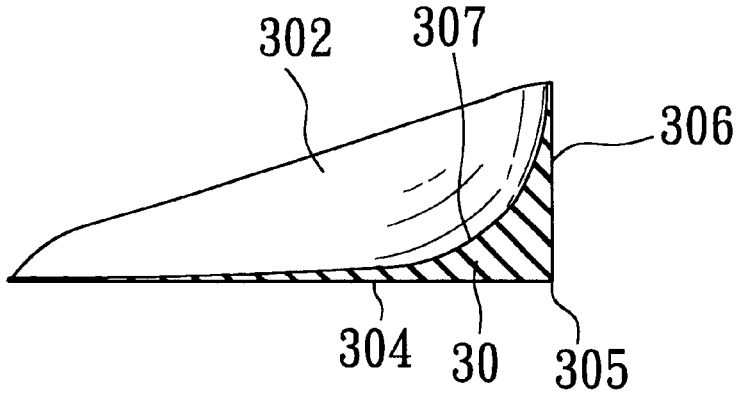
FIG. 7 is a sectional view taken along line 7—7 of FIG. 6.
Figure 8:
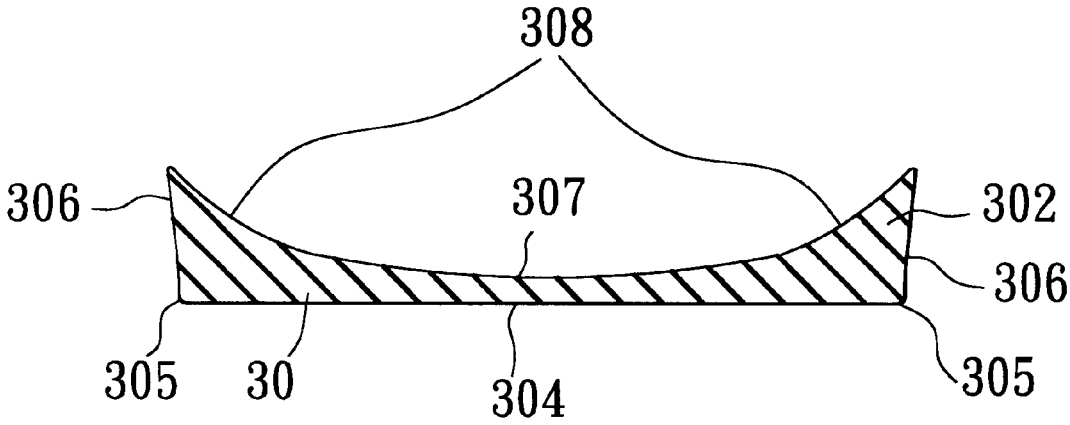
FIG. 8 is a sectional view taken along line 8—8 of FIG. 6.

The heel part 30 may be fabricated via a molding process from a rigid, semi-rigid, or flexible plastic material. The plastic materials usable for the heel part 30 include PVC, PU, EVA, EPE, etc. As shown in FIGS. 6, 7 and 8, the heel part 30 includes an upward flange 302 extending upward from the heel part 30 and making a substantially U-shaped turn around the heel part 30. The heel part 30 has a planar bottom face 304 which forms a corner 305 with an outer surface 306 of the upward flange 302. The heel part 30 further has an upper surface 307 which is opposite to the planar bottom face 304 and the outer surface 306. The upper surface 307 is concave and extends gradually upward and outward in a direction from a mid part of the heel part 30 to a top end of the upward flange 302. The thickness between the upper surface 307 and the planar bottom face 304 decreases gradually from the upward flange 302 toward the mid part of the heel part 30. A curvature 308 of the upper surface 307 opposite to the corner 305 has a diameter greater than 8 mm. The upper surface 307 of the heel part 30 conforms to the bottom convex surface of the wearer's heel.

Figure 9:
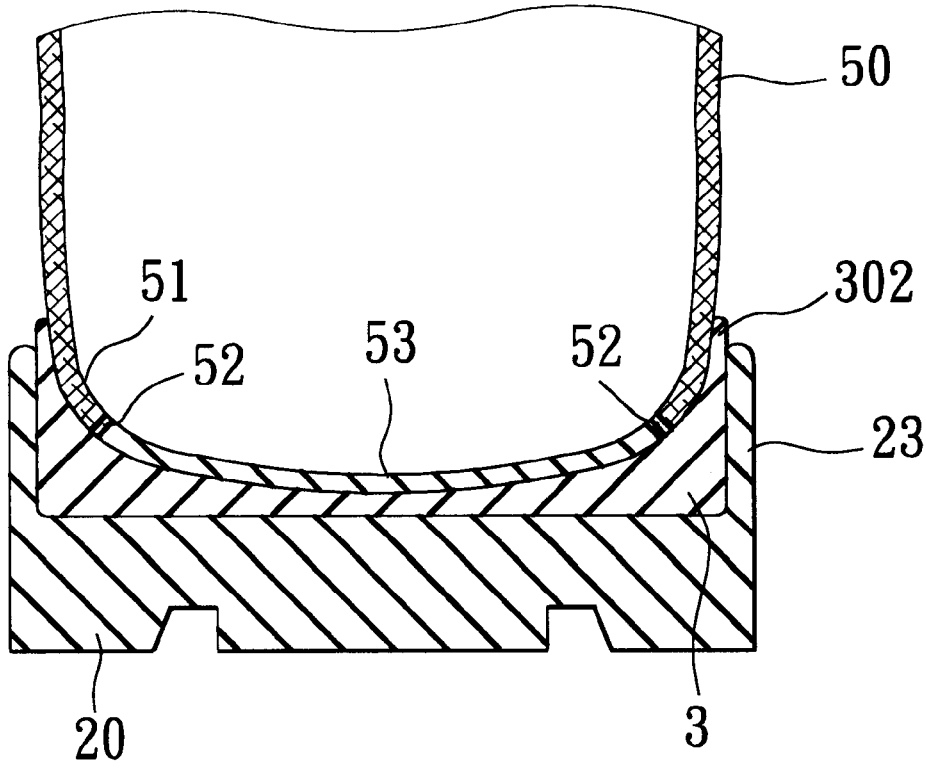
FIG. 9 is the same view as FIG. 5 but with the upward flange of a foot pad being higher than the peripheral flange of an outsole.

The upward flange 302 of the heel part 30 is surrounded by the peripheral flange 23 of the outsole 20, and the top end of the upward flange 302 is covered by the peripheral flange 23. Alternatively, the top end of the upward flange 302 may be higher than the peripheral flange 23, as shown in FIG. 9, so that the top end of the upward flange 302 is exposed from the peripheral flange 23.

Figure 5:
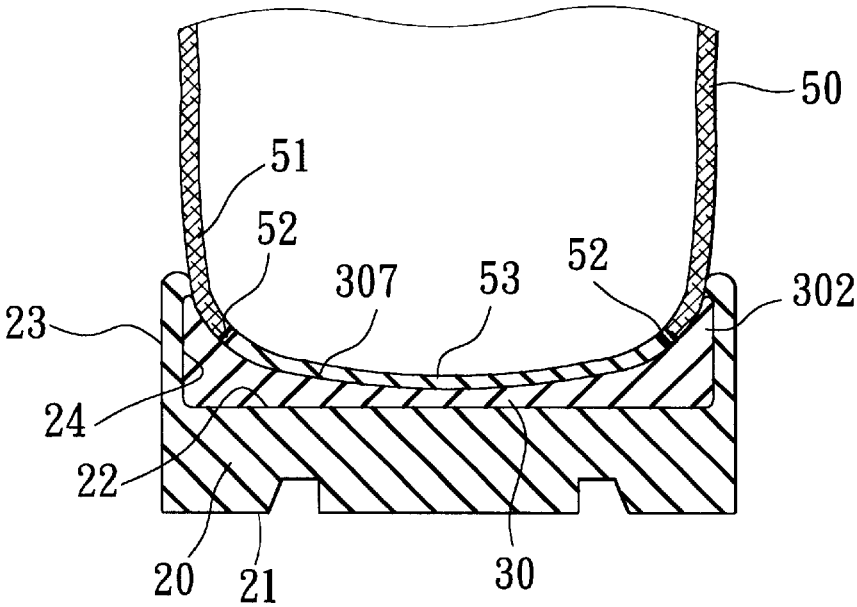
FIG. 5 is a sectional view taken along line 5—5 of FIG. 4.

As best shown in FIG. 5, the bottom margin 51 of the upper 50 and the inner sole 53 are attached to the concave upper surface 307 of the heel part 30 so that they are curved to conform to the contour of the upper surface 307 and so that no corner is formed at the region adjacent to the stitch seam 52.

Figure 10:
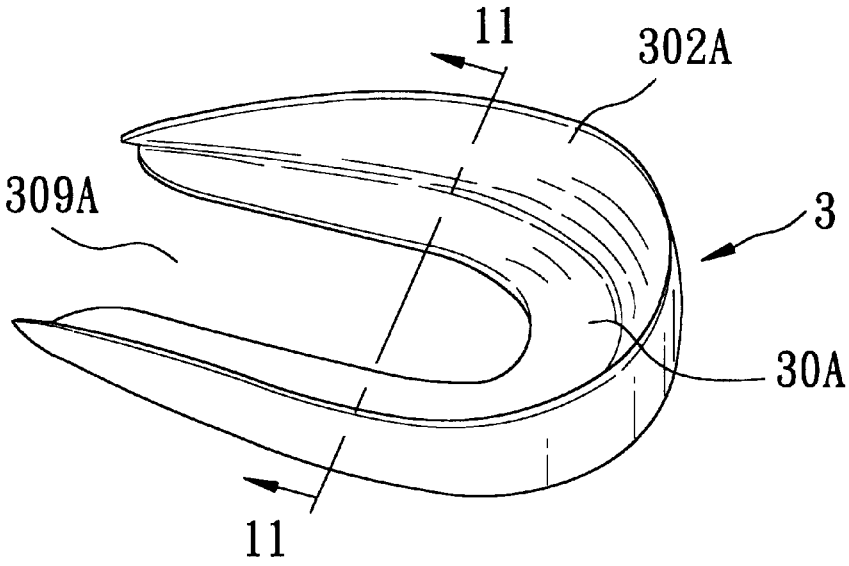
FIG. 10 is a perspective view of another heel part according to the present invention.
Figure 11:
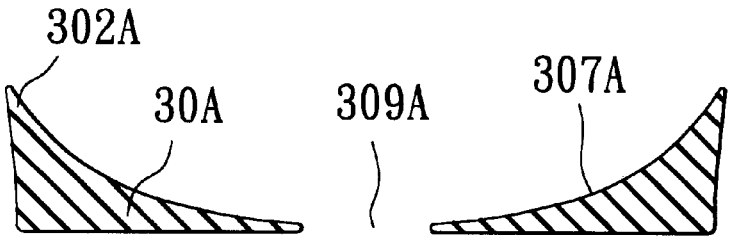
FIG. 11 is a sectional view taken along line 11—11 of FIG. 10.

Referring to FIGS. 10 and 11, the foot pad 3 according to the present invention may include a heel part 30A in place of the heel part 30 described hereinbefore. The heel part 30A has an upward flange 302A which is substantially the same as the upward flange 302 of the heel part 30 except that the heel part 30A is provided with an opening 309A substantially at the mid part thereof. Like the heel part 30, the thickness of the heel part 30A decreases gradually from the upward flange 302A towards the mid part of the heel part 30A, forming a concave upper surface 307A.

Figure 12:
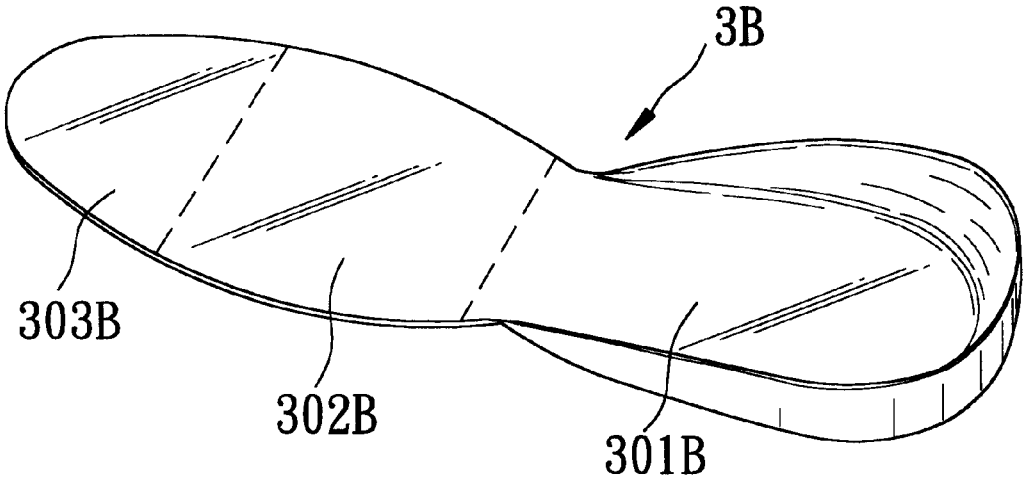
FIG. 12 is a perspective view of another foot pad according to the present invention.

Referring to FIG. 12, a foot pad 3B maybe used in place of the foot pad 3 shown in FIGS. 6 to 8, 10 and 11. The foot pad 3B includes a heel part 301B, a shank part 302B and a toe part 303B which are formed as one piece. The heel part 301B has substantially the same configuration as the heel part 30. The shank part 302B and the toe part 303B may be designed such that they are more flexible and have a lower hardness than that of the heel part 301B. The foot pad 3B may be constructed in such a manner that it has different levels of hardness at the heel, shank and toe parts 301B, 302B and 303B. Furthermore, the hardness of the foot pad 3B may be the same or different at the shank and toe parts 302B and 303B.

Figure 13:
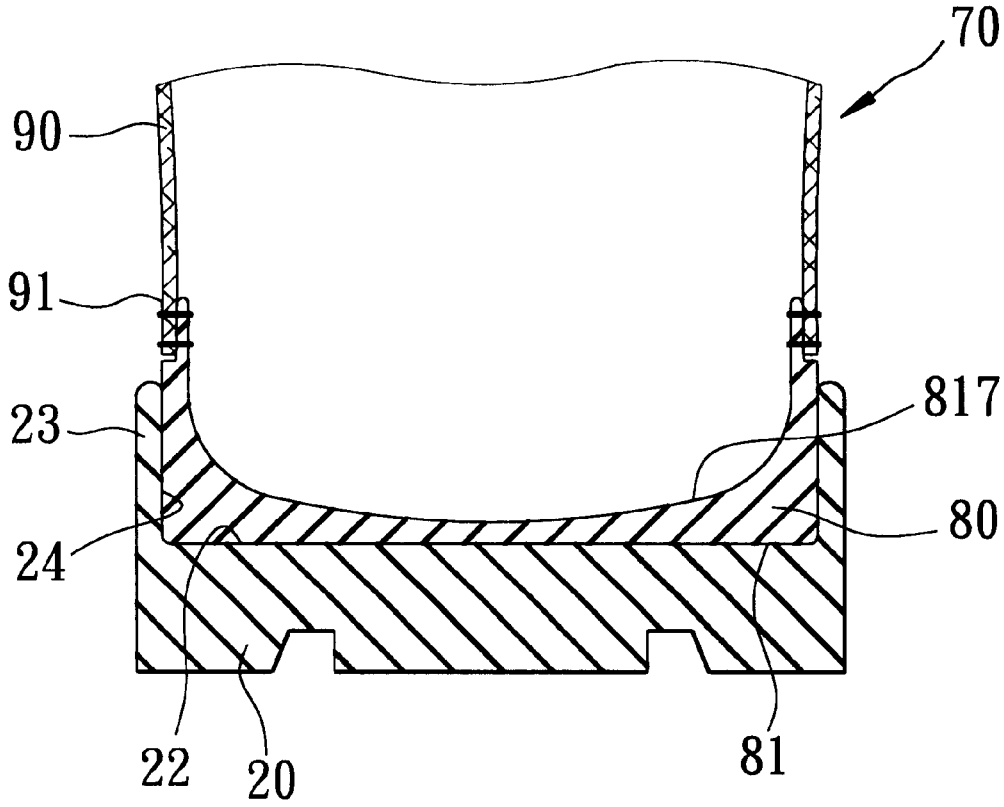
FIG. 13 is a sectional view of another shoe embodying the present invention.
Figure 14:
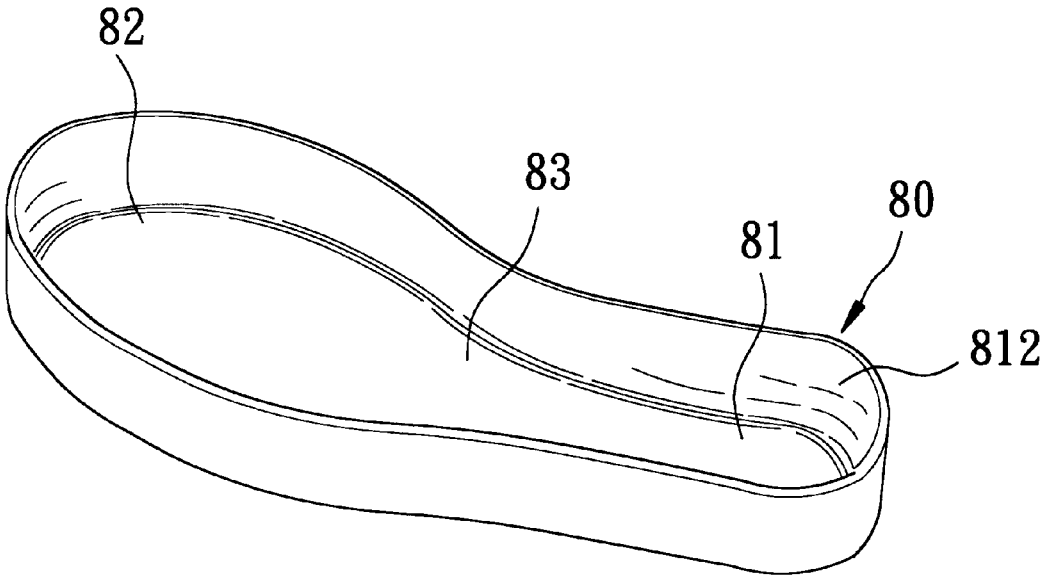
FIG. 14 is a sectional view taken along line 14—14 of FIG. 13.

Another shoe embodying the present invention is shown in FIGS. 13 and 14 in which elements corresponding to those described in the previous embodiment are represented by like numerals. A shoe 70 in this embodiment includes an outsole 20 which has a peripheral flange 23 and a cavity 24. An ergonomic foot pad 80 is disposed fittingly in the cavity 24 and has a bottom face 81 abutting against the upper face 22 of the outsole 20. 81, a toe part 82, and a shank part 83 that interconnects the heel part 81 and the toe part 82. The heel part 81 has a construction substantially corresponding to that of the heel part 30 and includes a concave upper surface 817 (see FIG. 13). In this embodiment, the upward flange 812 extends to the toe part 82 and makes another U-shaped turn at the front of the toe part 82, thus forming a loop. An upper 90 has a bottom margin 91 which is stitched to the upward flange 812 of the foot pad 80.

Figure 15:
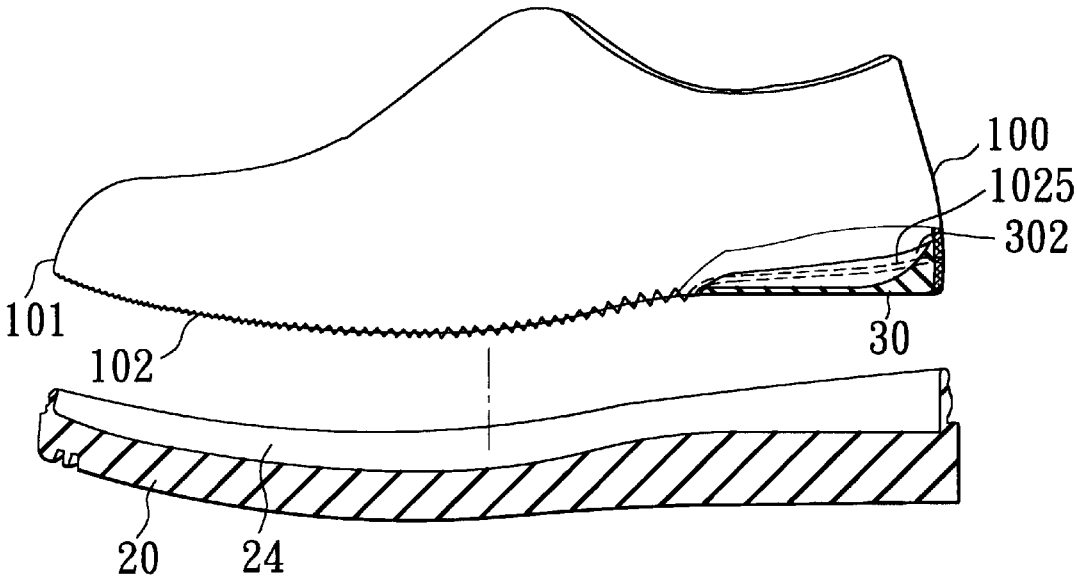
FIG. 15 is an exploded view of a further shoe embodying the present invention.
Figure 16:
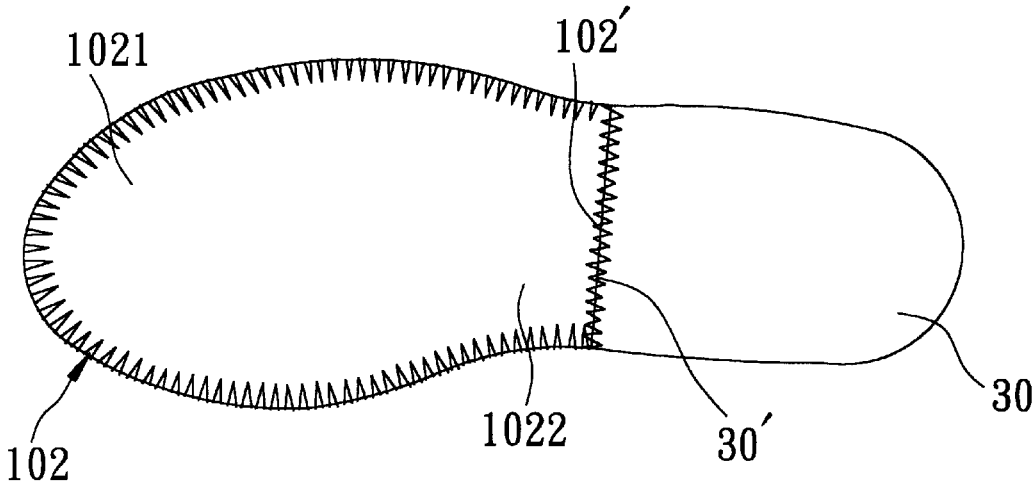
FIG. 16 is a bottom view of the shoe of FIG. 15 but with an outsole being removed.

Referring to FIGS. 15 and 16, an upper 100 has a bottom margin 101 stitched to an insole plate 102,and a heel part 30. In particular, the insole plate 102 has a toe section 1021 and a shank section 1022. The peripheral end of the insole plate 102 is stitched to the bottom margin 101 of the upper 100, and a rear end 102' of the shank section 1022 is stitched to a front end 30' of the heel part 30. The upward flange 302 of the heel part 30 extends inside the bottom margin 101 of the upper 100 and is stitched to the bottom margin 101 of the upper 100 along seams 1025. The bottom margin 101 of the upper 100 together with the insole plate 102 and the heel part 30 is inserted into the cavity 24 of the outsole 20.

Figure 17:
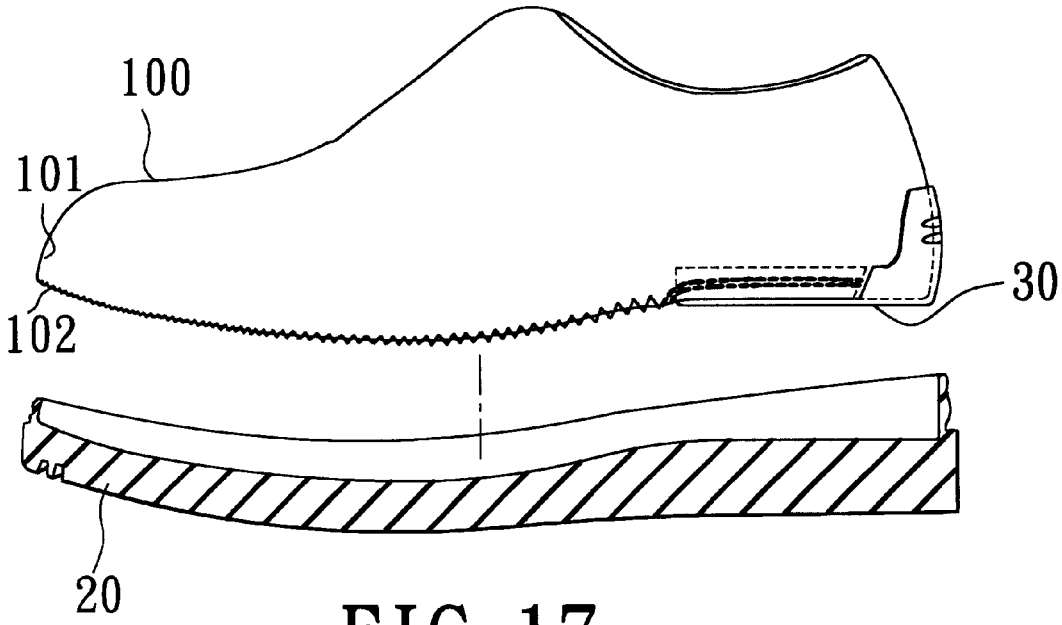
FIG. 17 is an exploded view of still further shoe embodying the present invention.
Figure 18:
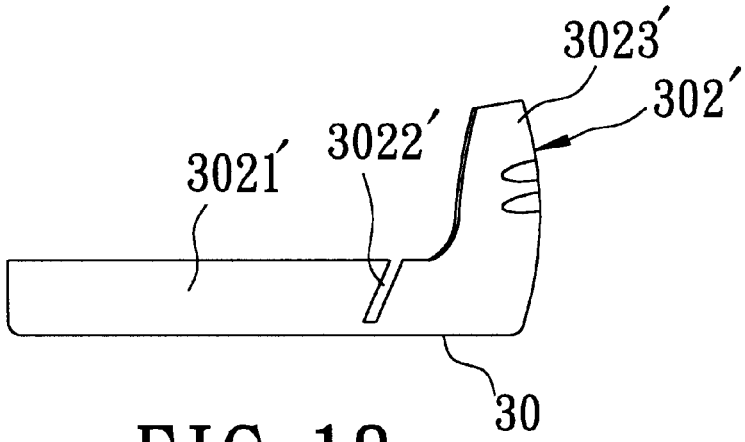
FIG. 18 is a side view of the heel part used in the shoe of FIG. 17.

Referring to FIGS. 17 and 18, an embodiment shown therein is substantially similar to that shown in FIGS. 15 and 16. The difference in this embodiment resides in that the heel part 30 has two opposite notches 3022' (only one notch is shown) formed respectively in two sides of an upward flange 302'. The notches 3022' separate the upward flange 302' into parts 3021' and 3023'. The parts 3021' of the upward flange 302' anterior to the notches 3022' extend inwardly of the bottom margin 101 of the upper 100, and a part 3023' of the upward flange 302' posterior to the notches 3022' extend outwardly of the bottom margin 101.

As described hereinbefore, the ergonomic foot pad 3, 3B or 80 is fitted in the cavity 24 the outsole 20. Since the ergonomic foot pad 3, 3B or 80 can be incorporated into the outsole 20 which has no concave upper surface conforming to the contour of the wearer's heel, the shoe 10 or 70 can be manufactured using common molds with other types of shoe which have outsoles without foot-conforming concave upper surfaces. Furthermore, due to the presence of the concave upper surfaces 307, 307A, 817, the foot pads 3, 3B and 80 can comfort the wearers' feet. In addition, the ergonomic foot pads 3, 3B and 80 can be manufactured by using less expensive and smaller molds as compared to molds for forming outsoles.

While the present invention has been described in connection with what is considered the most practical and preferred embodiment, it is understood that this invention is not limited to the disclosed embodiments but is intended to cover various arrangements included within the spirit and scope of the broadest interpretation so as to encompass all such modifications and equivalent arrangements.

I claim:

1. A shoe comprising:

an outsole having a lower tread face, an upper face, and a peripheral flange profecting upward from said upper face and confining a cavity above said upper face;

an ergonomic foot pad disposed inside said cavity and cemented to said outsole; and an upper connected to said foot pad, said foot pad including a heel part which has a bottom face connected to said outsole, and an upward flange projecting upward from a periphery of said heel part and making a U-shaped turn around said heel part, said heel part further having a concave upper surface which is opposite to said bottom face, said concave upper surface extending gradually upward and outward in a direction from a mid part of said heel part to a top end of said upward flange, said upward flange having an outer surface which forms a corner with said bottom face, said concave upper surface having a curved face opposite to and extending along said corner, said heel part having, between said bottom face and said concave upper surface, a thickness which decreases gradually from said upward flange toward said mid part of said heel part, wherein said upper includes an insole plate having a toe section and a shank section, said shank section having a rear end, said heel part having a front end stitched to said rear end of said shank section, said upper further having a bottom margin stitched to said insole plate and to said upward flange of said heel part.

2. The shoe as claimed in claim 1, wherein said curved face has a curvature with a diameter greater than 8 mm.

* * * * *